US007459865B2

(12) United States Patent
Honbo

(10) Patent No.: US 7,459,865 B2
(45) Date of Patent: Dec. 2, 2008

(54) COLD CATHODE TUBE LIGHTING DEVICE, TUBE CURRENT DETECTING CIRCUIT USED IN COLD CATHODE TUBE LIGHTING DEVICE, TUBE CURRENT CONTROLLING METHOD AND INTEGRATED CIRCUIT

(75) Inventor: Nobuaki Honbo, Kawasaki (JP)

(73) Assignee: NEC LCD Technologies, Ltd., Kanagawa (JP)

( * ) Notice: Subject to any disclaimer, the term of this patent is extended or adjusted under 35 U.S.C. 154(b) by 44 days.

(21) Appl. No.: 11/507,675

(22) Filed: Aug. 22, 2006

(65) Prior Publication Data

US 2007/0046216 A1 Mar. 1, 2007

(30) Foreign Application Priority Data

Aug. 23, 2005 (JP) ..... 2005-241682

(51) Int. Cl.
*G05F 1/00* (2006.01)

(52) U.S. Cl. ..... 315/291; 315/274; 315/279; 315/308; 315/324

(58) Field of Classification Search ..... 315/291, 315/297, 307–311, 224, 225, 209 R, 274–289, 315/312–326, 247, 246
See application file for complete search history.

(56) References Cited

U.S. PATENT DOCUMENTS

2006/0038508 A1* 2/2006 Lin et al. ..... 315/276

FOREIGN PATENT DOCUMENTS

| | | |
|---|---|---|
| JP | 2001-52891 | 2/2001 |
| JP | 2002-17090 | 1/2002 |
| JP | 3096242 | 6/2003 |
| JP | 2004-235123 | 8/2004 |
| JP | 2004-335443 | 11/2004 |
| JP | 2005-63941 | 3/2005 |
| JP | 2005-63970 | 3/2005 |

* cited by examiner

*Primary Examiner*—Tuyet Vo
(74) *Attorney, Agent, or Firm*—Young & Thompson

(57) ABSTRACT

A cold cathode tube lighting device is provided which is capable of achieving stable luminance when driven by applying driving pulses to input terminals on both sides of each of two or more cold cathode tubes. Each of currents flowing through coils in each of coil units on both sides of each of two or more cold cathode tubes is detected by voltage detecting sections and a tube current flowing through each of the cold cathode tubes based on a value obtained by adding each of the currents using an adder and a duty ratio of each of driving pulses is controlled so that the tube current becomes a specified current value to keep the luminance of the cold cathode tubes constant.

20 Claims, 12 Drawing Sheets

COLD CATHODE TUBE LIGHTING DEVICE, TUBE CURRENT DETECTING CIRCUIT USED IN COLD CATHODE TUBE LIGHTING DEVICE, TUBE CURRENT CONTROLLING METHOD AND INTEGRATED CIRCUIT

BACKGROUND OF THE INVENTION

1. Field of the Invention

The present invention relates to a cold cathode tube lighting device, tube current detecting circuit to be used in a plurality of cold cathode tubes, tube current controlling method, and integrated circuit and more particularly to the cold cathode tube lighting device which can be suitably used when the plurality of the cold cathode tubes being used as a backlight for a liquid crystal display device is driven by pulses output from inverters supplied to input terminals on both sides of each of the cold cathode tubes, to the tube current detecting circuit to be used in the cold cathode tube lighting device, the tube current controlling method, and the integrated circuit.

The present application claims priority of Japanese Patent Application No. 2005-241682 filed on Aug. 23, 2005, which is hereby incorporated by reference.

2. Description of the Related Art

In recent years, a liquid crystal display device is used not only for monitors of personal computers but also for various display devices such as liquid crystal panel television sets. In the case of the liquid crystal panel television sets or a like in particular, upsizing of a liquid crystal panel itself is progressing. As a result, a backlight used in each of the liquid crystal display devices is increasing in size and a cold cathode tube in the backlight is also made long. When a cold cathode tube is to be lit, in the case of a short cold cathode tube, its one input terminal is used as a low-voltage side and the other input terminal as a high-voltage side and a driving pulse is input from an input terminal on the high-voltage side.

However, in the case of a long cold cathode tube or a cold cathode tube having a small diameter, since impedance of the cold cathode tube becomes high, when a driving pulse is input from one input terminal (on a high-voltage side) of the cold cathode tube, a display area in a region near to the input terminal on the high-voltage side becomes bright and the display area in a region near to the input terminal on the low-voltage side becomes dark, causing a luminance gradient to occur. To prevent the occurrence of the luminance gradient, a both-side high-voltage driving method is employed in which a cold cathode tube is made to light by applying driving pulse voltages with different phases to input terminals on both sides of the cold cathode tube. Moreover, in order to improve the efficiency of the backlight, even in the case where a cold cathode tube is of "U"-shaped or "コ"-shaped or even in the case where a diameter of the cold cathode tube is small, the both-side high-voltage driving device is used in some cases. Moreover, there is a method by which a plurality of cold cathode tubes is made to light by using one inverter. However, if the cold cathode tube is long, unless high voltages are input from input terminals on both sides of the cold cathode tube, a luminance gradient occurs in the cold cathode tube.

Luminance of a cold cathode tube is determined by a tube current flowing through the cold cathode tube. Therefore, in a one-side high voltage driving method in which driving pulses are applied to an input terminal on one side of a cold cathode tube, a current detecting circuit made up of resistors or a like is mounted on a low-voltage side to which driving pulses are not applied to exercise control to keep constant the luminance of the cold cathode tube based on detected current values, whereas, in the both-side high voltage driving method, voltages of the driving pulses which are applied to both the input terminals of the cold cathode tube are high and a current detecting circuit such as a resistor cannot be inserted, which, as a result, makes it impossible to detect a tube current of the cold cathode tube.

Conventional technology of this type is disclosed in following References. A driving device of a piezoelectric transformer disclosed in Patent Reference (Japanese Patent Application Laid-open No. 2002-017090, Abstract, FIG. 1), as shown in FIG. 12, includes a power source 11, a driving circuit 12, a variable oscillating circuit 13, an oscillation controlling circuit 14, a piezoelectric transformer 15, a voltage detecting circuit 16, a current detecting circuit 17, a phase difference detecting circuit 18, and an effective current detecting circuit 19. Between the piezoelectric transformer 15 and the current detecting circuit 17 is connected a cold cathode tube 20. A reflecting plate 21 being grounded is connected near the cold cathode tube 20 and floating capacitance Cx is formed between the cold cathode tube 20 and the reflecting plate 21. In a driving device of the piezoelectric transformer 15, a tube current (current output from the piezoelectric transformer 15) of the cold cathode tube 20 is detected by the current detecting circuit 17 and a phase difference between a current and voltage output from the piezoelectric transformer 15 is detected by the phase difference detecting circuit 18. Based on the detected phase difference, an effective current flowing through the cold cathode circuit 18 is detected by the effective current detecting circuit 19 and the piezoelectric transformer 15 is controlled for driving via the oscillation controlling circuit 14, variable oscillating circuit 13, and driving circuit 12 so that the effective current becomes equal to a predetermined set value.

In a discharge tube inverter circuit for lighting multiple lamps disclosed in Patent Reference 2 (Japanese Patent Application Laid-open No. 2004-335443, Abstract, FIG. 1), driving pulses are applied from one inverter through a shunt transformer to a plurality of discharge tubes to cause each of cold cathode tubes to be lit. The shunt transformer has inductance exceeding a negative resistance characteristic of the cold cathode tube. By adjusting the inductance, a tube current flowing through each cold cathode tube is made uniform.

In a cold cathode tube light-calibrating device disclosed in Patent Reference 3 (Japanese Utility Model Gazette 3096242, Abstract, FIG. 1), driving pulses fed from a high-voltage side of an inverter are supplied through a ballast capacitor to an input terminal on one side (high-voltage side) of each of two or more cold cathode tubes. On a low voltage side of the inverter is connected a current detecting circuit made up of a resistor and, based on a detected current value, a duty ratio of each of the driving pulses is controlled to exercise control to keep the luminance of the cold cathode tube constant.

In a separately-excited inverter disclosed in Patent Reference 4 (Japanese Patent Application Laid-open No. 2001-052891, Abstract, FIG. 1), there are provided an inverter transformer whose primary winding is of a push-pull configuration, two switching elements to control on/off both sides of the primary winding, and a clock signal generating circuit to supply clocking signals with different phases to the two switching elements. This allows oscillation frequency to be set freely without a constraint of a resonance frequency of the inverter transformer.

In the case of a discharge lamp lighting device disclosed in Patent Reference 5 (Japanese Patent Application Laid-open No. 2004-235123, Abstract, FIG. 1), in a video device using a cold cathode tube as a light source, driving pulses fed from a high-voltage side of an inverter are applied to an input terminal on one side (high-voltage side) of one cold cathode tube. On a low-voltage side of an inverter is mounted a current detecting circuit made up of resisters and, based on a detected current value, a tube current of the cold cathode tube is controlled by a PWM (Pulse Width Modulation) method and resolution obtained by the PWM method is expanded by a bit reducing circuit.

In a cold cathode tube lighting device disclosed in Patent Reference 6 (Japanese Patent Application Laid-open No. 2005-063941, Abstract, FIG. 1), a plurality of cold cathode tubes is lit in a uniform and stable manner by a low-impedance power source serving as one common power source and by a plurality of ballasts connected to at least one of two or more cold cathode tubes.

In the lamp driving circuit disclosed in Patent Reference 7 (Japanese Patent Application Laid-open No. 2005-063970, Abstract, FIG. 1), a temperature sensor is mounted near to an external electrode of a lamp and a state of the lamp is monitored. As a result of the monitoring, when a temperature of the lamp falls within a critical temperature range, a tube current decreases and when the temperature exceeds the critical temperature range, supply of power to the lamp is turned OFF.

However, the above conventional technologies have the following problems. In the driving device of the piezoelectric transformer disclosed in the Patent Reference 1, due to a high voltage output from the piezoelectric transformer 15, a high-withstand component is required as a component to which such a high voltage is applied, causing high costs. A tube current is detected on one side of the cold cathode tube 20 and, therefore, a current of the tube cannot be detected exactly due to variation between terminals in the piezoelectric transformer 15 and/or cold cathode tube 20.

In the discharge tube inverter circuit for lighting multiple lamps disclosed in the Patent Reference 2, though a tube current flowing though each cold cathode tube is made uniform, since a value of the tube current cannot be changed, no control to keep the luminance of the cold cathode tube constant is exercised. The purpose of the cold cathode tube light-calibrating device disclosed in the Patent Reference 3 is to drive each cold cathode tube by one-side voltage driving method and, therefore, the purpose and configuration of the conventional device are different from those of the present invention.

The purpose of the separately-excited inverter disclosed in the Patent Reference 4 is to perform light calibration independently on a plurality of cold cathode tubes and, therefore, the purpose and configuration of the conventional inverter are different from those of the present invention.

In the case of the discharge lamp lighting device disclosed in the Patent Reference 5, the cold cathode tube is driven by the one-side high voltage driving method and, therefore, the purpose and configuration of the conventional inverter are different from those of the present invention.

In the cold cathode tube lighting device disclosed in the Patent Reference 6, a plurality of cold cathode tubes is driven by the one-side high voltage driving method and the purpose and configuration of the conventional inverter are different from those of the present invention.

In the lamp driving device disclosed in the Patent Reference 7, a temperature of the lamp is detected by the temperature sensor and the supply of power to the lamp is controlled and, therefore, the purpose and configuration of the conventional inverter are different from those of the present invention.

SUMMARY OF THE INVENTION

In view of the above, it is an object of the present invention to provide a cold cathode tube lighting device which is capable of keeping a tube current flowing through cold cathode tubes constant and luminance unchanged when a plurality of cold cathode tubes is driven by an inverter according to a both-side high-voltage driving method.

According to a first aspect of the present invention, there is provided a cold cathode tube lighting device for lighting two or more cold cathode tubes by applying driving pulses with different phases to be output from each of inverters through each of ballast elements used to make uniform a tube current of each of the cold cathode tubes to input terminals on both sides of each of two or more cold cathode tubes including:

a tube current controlling unit to detect a tube current flowing through each of the cold cathode tubes based on each current flowing through each of ballast elements and to control so that the tube current becomes a specified current value.

In the foregoing, a preferable mode is one wherein the inverter includes first and second separately-excited inverters and wherein the tube current controlling unit detects each current flowing through each of the ballast elements on both sides of each of the two or more cold cathode tubes and calculates the tube current based on a value obtained by adding each current and sets a duty ratio of each of the driving pulses on each of the separately-excited inverters so that the tube current becomes the specified current value.

Also, a preferable mode is one wherein the inverter includes first and second separately-excited inverters and wherein the tube current controlling unit detects each current flowing through each of the ballast elements on both sides of each of the two or more cold cathode tubes and calculates the tube current based on a value obtained by adding each current and sets a frequency of each of the driving pulses on each of the separately-excited inverters so that the tube current becomes the specified current value.

Also, a preferable mode is one wherein the inverter includes first and second self-excited inverters and wherein the tube current controlling unit detects each current flowing through each of the ballast elements on both sides of each of the two or more cold cathode tubes and calculates the tube current based on a value obtained by adding each current and controls a time width during which each of the driving pulses is output by each of the self-exiting inverters so that the tube current becomes the specified current value.

Also, a preferable mode is one wherein each of the ballast elements includes a coil and wherein first and second voltage-reducing coils are provided which generate a voltage being lower than a voltage across each of coils each being coupled inductively to each of the coils connected to each of input terminals on both sides of one of the two or more cold cathode tubes and wherein the tube current controlling unit detects a current flowing through each of the coils based on a voltage to be generated in each of the voltage-reducing coils.

Also, a preferable mode is one wherein a temperature detecting unit is provided which detects a temperature of each of the cold cathode tubes and wherein the tube current controlling unit detects a tube current flowing through each of the cold cathode tubes based on each current flowing through each of the ballast elements and on a temperature of each of the cold cathode tubes detected by the temperature detecting unit and exercises control so that the tube current becomes a specified current value.

Also, a preferable mode is one wherein a voltage monitoring unit is provided which detects a voltage of each of the driving pulses to be applied to each of input terminals of each of the cold cathode tubes and stops operations of each of the inverters when abnormality occurs in at least one driving pulse.

According to a second aspect of the present invention, there is provided a tube current detecting circuit to be used for a cold cathode tube lighting device which applies driving pulses with different phases to be output from each of inverters through each of ballast elements used to make uniform a tube current of each of the cold cathode tubes to input terminals on both sides of each of two or more cold cathode tubes and to detect a tube current flowing through each of the cold cathode tubes based on each current flowing through each of ballast elements, the tube current detecting circuit including:

each coil making up each of the ballast elements; and first and second voltage-reducing coils to generate a voltage being lower than a voltage across each of coils each being coupled inductively to each of the coils connected to each of input terminals on both sides of one of the two or more cold cathode tubes.

According to a third aspect of the present invention, there is provided a tube current controlling method to be used in a cold cathode tube lighting device which applies driving pulses with different phases to be output from each of inverters through each of ballast elements used to make uniform a tube current of each of the cold cathode tubes to input terminals on both sides of each of two or more cold cathode tubes, the tube current controlling method including:

detecting a tube current flowing through each of the cold cathode tubes based on each current flowing through each of the ballast elements and exerting control so that the tube current becomes a specified value.

In the foregoing aspects, a preferable mode is one wherein the tube current controlling unit is configured as one chip of an integrated circuit.

Also, a preferable mode is one wherein the temperature detecting unit and the tube current controlling unit are together configured as one chip of an integrated circuit.

Also, a preferable mode is one wherein the tube current controlling unit and the voltage monitoring unit are together configured as one chip of an integrated circuit.

Also, a preferable mode is one wherein the temperature detecting unit, the tube current controlling unit and the voltage monitoring unit are together configured as one chip of an integrated circuit.

With the above configuration, a tube current flowing through each of the cold cathode tubes is detected by the tube current controlling means based on each current flowing through each of the ballast elements and each tube current is controlled so as to become a specified current value and, therefore, luminance of each of the cold cathode tubes can be kept constant. Each current flowing through each of the ballast elements connected to both sides of each of the two or more cold cathode tubes is detected by the tube current controlling means and a tube current is calculated based on a value obtaining by adding each current, and a duty ratio is set by the tube current controlling means on each of the separately-excited inverters making up the tube current controlling means and, therefore, luminance of each of the cold cathode tubes can be also kept constant. Each current flowing through the ballast elements connected to both sides of each of the two or more cold cathode tubes and a tube current is calculated based on a value obtained by adding each current and a frequency of each of the driving pulses is set on each of the separately-excited inverters by the tube current controlling means so that the tube current becomes a specified current value and, therefore, luminance of each of the cold cathode tubes can be kept constant.

Also, each current flowing through each of the ballast elements connected to both sides of each of the two or more cold cathode tubes and a tube current is calculated based on a value obtained by adding each current and a time width during which each of the driving pluses to be output by each of the self-exciting inverters is controlled by the tube current controlling means so that the tube current becomes a specified current value and, therefore, luminance of each of the cold cathode tubes can be kept constant. Also, a current flowing through each coil serving as a ballast element is detected by the tube current controlling means based on a voltage occurring in each of the voltage-reducing coils and, therefore, the tube current controlling means can be constructed by using components with specifications for low voltages. Moreover, a tube current flowing through each of the cold cathode tubes is detected by the tube current controlling means based on each current flowing through each of the ballast elements and on a temperature of each cold cathode tube detected by the temperature detecting means and the tube current is controlled so as to become a specified current value and, therefore, luminance of each of the cold cathode tubes can be kept constant with more accuracy. Furthermore, a voltage of each of the driving pulses to be applied to each input terminal of each of the cold cathode tubes is detected by the voltage monitoring means and, when abnormality occurs in at least one of the driving pulses, operations of each of the inverters is stopped and, therefore, luminance of each of the cold cathode tubes can be kept constant and an accident that a voltage of the driving pulse becomes excessive can be avoided.

BRIEF DESCRIPTION OF THE DRAWINGS

The above and other objects, advantages, and features of the present invention will be more apparent from the following description taken in conjunction with the accompanying drawings in which.

DETAILED DESCRIPTION OF THE PREFERRED EMBODIMENTS

Best modes of carrying out the present invention will be described in further detail using various embodiments with reference to the accompanying drawings. According to the present invention, each current flowing through each coil serving as a ballast element connected to both sides of each cold cathode tube and a tube current flowing through each of the cold cathode tubes is calculated based on a value obtained by adding each current value, and a duty ratio and frequency of each of driving pulses are set to provide a cold cathode tube lighting device being capable of keeping constant luminance of each of the cold cathode tubes.

First Embodiment

Figure 1:
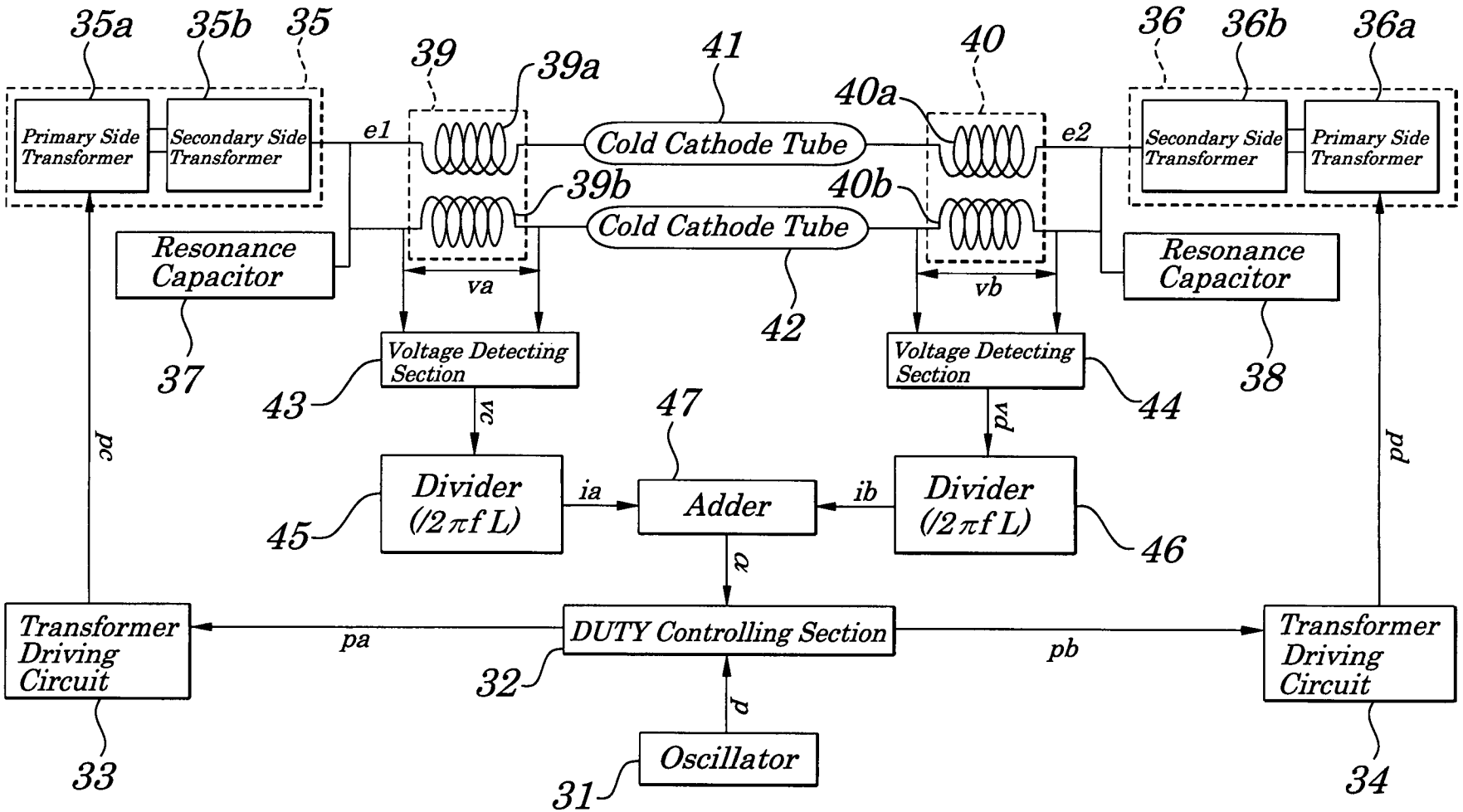
FIG. 1 is a block diagram showing electrical configurations of main components of a cold cathode lighting device according to a first embodiment of the present invention.

FIG. 1 is a block diagram showing electrical configurations of main components of a cold cathode lighting device according to the first embodiment of the present invention. The cold cathode lighting device of the first embodiment, as shown in FIG. 1, includes an oscillator 31, a DUTY controlling section 32, transformer driving circuits 33 and 34, transformers 35 and 36, resonance capacitors 37 and 38, coil units 39 and 40, cold cathode tubes 41 and 42, voltage detecting sections 43 and 44, dividers 45 and 46, and an adder 47. The oscillator 31 generates an output signal "p" forming a rectangular wave or triangular wave having a specified frequency and its oscillation frequency is set, in a fixed manner, so as to be near to a resonance frequency of a resonance circuit made up of inductors on secondary-sides 35*b* and 36*b* of the transformers 35 and 36, respectively, and resonance capacitors 37 and 38. The DUTY controlling section 32 receives an output signal "p" from the oscillator 31 and controls the signal so as to have a duty ratio corresponding to a tube current value "α" and outputs high-frequency pulses "pa" and "pb".

Each of the transformer driving circuits 33 and 34 is constructed of a buffer or a like made of, for example, a MOSFET (Metal Oxide Semiconductor FET) and outputs high-frequency pulses "pc" and "pd" at a level corresponding to that of the primary sides 35*a* and 36*a* of the transformers 35 and 36, respectively, based on the high-frequency pulses "pa" and "pb" fed from the DUTY controlling section 32. The transformers 35 and 36 input high-frequency pulses "pc" and "pd" output from the transformer driving circuits 33 and 34 to the primary and secondary sides 35*a* and 36*a* and output driving pulses with different phases from high-voltage sides of the secondary sides 35*b* and 36*b*, respectively. Voltages of these driving pulses "e1" and "e2" are set at a sufficient value to light the cold cathode tubes 41 and 42. The resonance capacitors 37 and 38 make up resonance circuits in combination with inductors on the secondary sides 35*b* and 36*b* of the transformers 35 and 36, respectively. Two separately-excited inverters are formed by these transformer driving circuits 33 and 34, transformers 35 and 36, and resonance capacitors 37 and 38, respectively.

The coil unit 39 is made up of coils 39*a* and 39*b* which are connected respectively to input terminals (electrodes) of the cold cathode tubes 41 and 42 and the coil unit 40 is made up of coils 40*a* and 40*b* which are connected respectively to input terminals (electrodes) of the cold cathode tubes 41 and 42. The coil units 39 and 40 serve as a ballast element to make uniform tube currents of the cold cathode tubes 41 and 42. Here, when driving pulses are applied from one transformer (inverter) to a plurality of cold cathode tubes, if a ballast element made up of a coil or capacitor is not inserted for every cathode tube between an output side of the transformer and the cold cathode tube, a phenomenon occurs in which only one specified cold cathode tube is lit due to a negative resistance characteristic that the cold cathode tube has. Due this, it is necessary that the ballast element is connected to for every cold cathode tube. The voltage detecting section 43 detects a voltage "va" across the coil 39*b* to generate a voltage detecting signal "vc" and the voltage detecting section 44 detects a voltage "vb" across the coil 40*b* to generate a voltage detecting signal "vd". The divider 45 generates a current value "ia" by dividing the voltage detecting signal "vc" fed from the voltage detecting section 43 by a value ($2\pi fL$, "L" denoting inductance, "f" denoting frequency of driving pulse voltages "e1" and "e2") of impedance of the coil 39*b* and the divider 46 generates a current value "ib" fed from the voltage detecting section 44 by dividing the voltage detecting signal "vd" by the value of the impedance of the coil 40*b*. The adder 47 adds the current "ia" value to a current value "ib" to generate a tube current value "α" of the cold cathode tube 42. The DUTY controlling section 32 exerts duty-ratio control on the signal "p" output from the oscillator 31 so that the tube current "α" fed from the adder 47 becomes a specified current value and outputs high-frequency pulses "pa" and "pb". The above voltage detecting sections 43 and 44, dividers 45 and 46, adders 47, and the DUTY controlling section 32 make up a tube current controlling means which is constructed as a one-chip integrated circuit.

Figure 2:
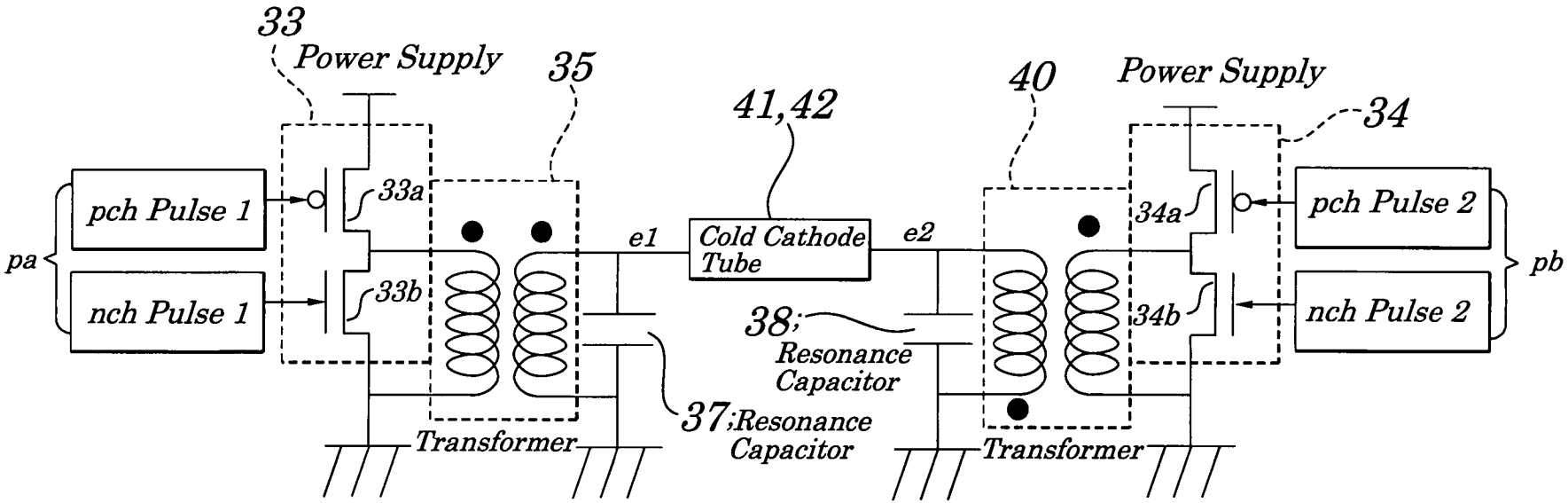
FIG. 2 is a block diagram showing transformer driving circuits, transformers and resonance capacitors and cold cathode tubes taken from FIG. 1.

FIG. 2 is a diagram showing the transformer driving circuits 33, and 34, transformers 35 and 36, resonance capacitors 37 and 38, and cold cathode tubes 41 and 42 taken from FIG. 1. As shown in FIG. 2, the transformer driving circuit 33 has a p-channel MOSFET (hereinafter simply "pMOS") 33*a* and an n-channel MOSFET (hereinafter simply "nMOS") 33*b*. The pMOS 33*a* is on/off controlled by a pch (channel) pulse 1 contained in the high-frequency pulse "pa" output from the DUTY controlling section 32 and the nMOS 33*b* is on/off controlled by a nch pulse 1 in the high-frequency pulse "pa". The transformer driving circuit 34 has a pMOS 34*a* and nMOS 34*b*. The pMOS 34*a* is on/off controlled by a pch (channel) pulse 2 contained in the high-frequency pulse "pb" output from the DUTY controlling section 32 and the nMOS 34*b* is on/off controlled by a nch pulse 2 in the high-frequency pulse "pb".

Figure 3:
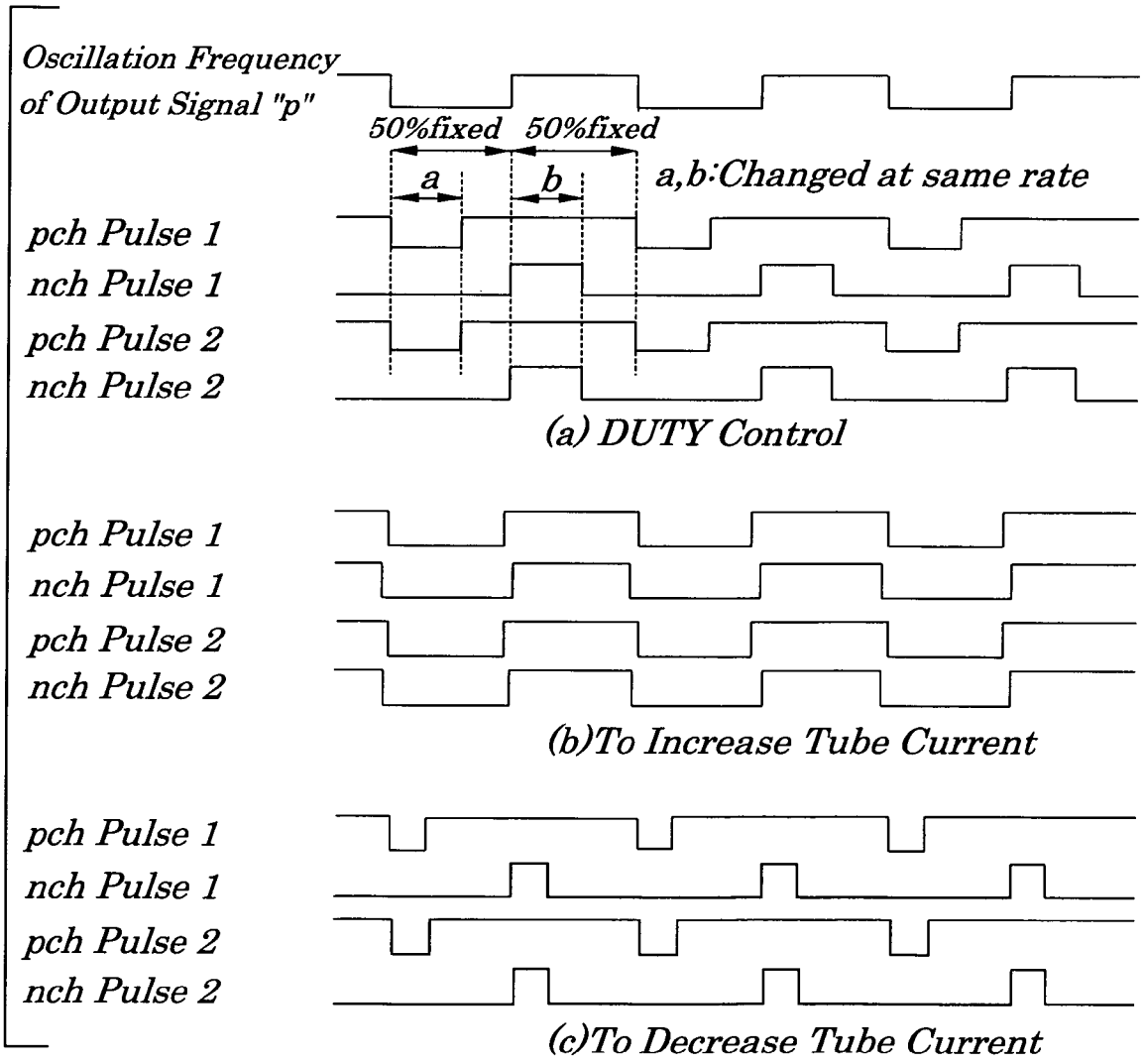
FIG. 3 is a time chart explaining operations of the components shown in FIG. 2.

FIG. 3 is a time chart explaining operations of the components shown in FIG. 2. By referring to FIG. 3, a method for controlling a tube current to be applied to the cold cathode tube lighting device of the first embodiment is described. In the cold cathode tube lighting device, the driving pulse e1 is supplied to the input terminal of the cold cathode tube 41 through the coil unit 39 and the driving pulse e2 is supplied to the input terminal of the cold cathode tube 42 through the coil unit 40, in which the driving pulses e1 and e2 have phases different from each other and, based on each current flowing through the coils 39*b* and 40*b*, a tube current flowing through the cold cathode tube 42 is detected and a duty ratio of each of the driving pulses e1 and e2 is controlled so that the tube current becomes a specified current value.

That is, an output signal "p" with a specified frequency is generated by the oscillator 31 and is then input to the DUTY controlling section 32. From the DUTY controlling section 32 is output high-frequency pulses "pa" and "pb" so controlled as to have a duty ratio corresponding to the tube current value "α". From the transformer driving circuits 33 and 34 are output high-frequency pulses "pc" and "pd" generated based on the high-frequency pulses "pa" and "pb". Each of the high-frequency pulses "pc" and "pd" is input to each of the primary sides 35*a* and 36*b* of the transformers 35 and 36 respectively and the driving pulse e1 is output from the high-voltage side of the secondary side 35*b* of the transformer 35 and the driving pulse e2 is output from the high-voltage side 36*b* of the transformer 36 in which a phase of the driving pulse e1 is opposite to that of the driving pulse e2. The driving pulses e1 and e2 are applied to the cold cathode tubes 41 and 42 respectively, which causes the cold cathode tubes 41 and 42 to be lit.

A voltage "va" across the coil 39*b* in the coil unit 39 is detected by the voltage detecting section 43 and a voltage detecting signal "vc" is generated. A voltage "vb" across the coil 40*b* in the coil unit 40 is detected by the voltage detecting section 44 and a voltage detecting signal "vd" is generated. The voltage detecting signals "vc" and "vd" are divided by impedance (2πfl) of the coils 39*a* and 40*b* by the dividers 45 and 46, respectively, to generate current values "ia" and "ib" of the coils 39*b* and 40*b*. The current value "ia" is added to the current value "ib" by the adder 47 to generate the tube current "α" of the cold cathode tube 42. The DUTY controlling section 32 exercises a duty-ratio control on the output signal "p" from the oscillator 31 so that the tube current "α" becomes a specified current value.

That is, as shown in FIG. 3(*a*), a pulse width "a" of the pch pulses 1 and 2 and a pulse width "b" of the nch pulses 1 and 2 are changed by the DUTY controlling section 32 at the same rate and, by making ON time of pMOSs 33*a* and 34*a* and ON time of nMOSs 33*b* and 34*b* be equal to each other and by controlling the ON time so as to correspond to the tube current value "α" to be output from the adder 47, the tube currents of the cold cathode tubes 41 and 42 become a specified current value. For example, to increase a tube current, as shown in FIG. 3(*b*), ON time is made longer and, to decrease the tube current, as shown in FIG. 3(*c*), the ON time is made shorter. By this control, tube currents of the cold cathode tubes 41 and 42 reach a specified current value and luminance of the cold cathode tubes 41 and 42 can be kept constant.

Thus, according to the first embodiment, each of currents flowing through the coils 39*a* and 40*b* in the coil units 39 and 40 connected to both sides of each of the cold cathode tubes 41 and 42, respectively, is detected and a tube current value "α" flowing through the cold cathode tube 42 is obtained based on a value obtained by adding each of the currents, and a duty ratio of each of the driving pulses e1 and e2 is set so that the tube current value "α" becomes a specified current value and, therefore, luminance of the cold cathode tubes 41 and 42 becomes constant.

Second Embodiment

Figure 4:
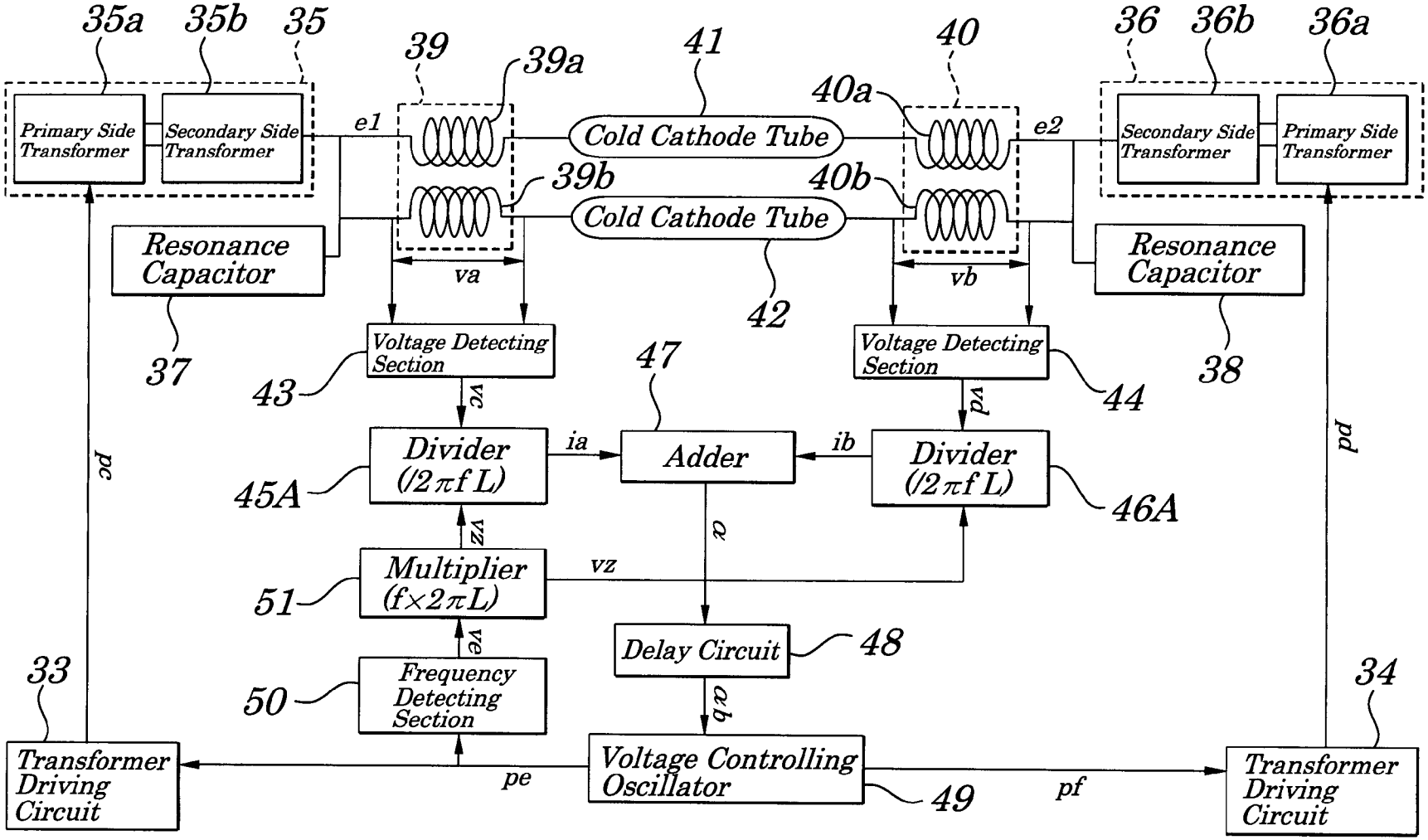
FIG. 4 is a block diagram showing electrical configurations of main components of a cold cathode lighting device according to a second embodiment of the present invention.

FIG. 4 is a block diagram showing electrical configurations of main components of a cold cathode lighting device according to the second embodiment of the present invention. In FIG. 4, same reference numbers are assigned to components having the same functions as those in the first embodiment shown in FIG. 1. The cold cathode tube lighting device of the second embodiment, as shown in FIG. 4, the oscillator 31 and DUTY controlling section 32 shown in FIG. 1 are not employed and a delay circuit 48, a voltage controlling oscillator 49, a frequency detecting section 50, and a multiplier 51 are mounted newly. Instead of the dividers 45 and 46 shown in FIG. 1, dividers 45A and 46A having functions different from those shown in FIG. 1 are installed. The delay circuit 48, for example, when the cold cathode tube lighting device is turned ON, does not send out a tube current "α" to be output from the adder 47 until a current starts flowing through the cold cathode tube 41 and 42 in a stable manner and, after the current starts flowing through the cold cathode tubes 41 and 42 in a stable manner, sends out the tube current "α", as a tube current value "αb", to the voltage controlling oscillator 49.

The voltage controlling oscillator 49 sets an oscillation frequency so that the tube current "αb" to be sent out from the delay circuit 48 becomes a specified current value and then outputs high-frequency pulses "pe" and "pf". The frequency detecting section 50 detects frequencies of the high-frequency pulses "pe" and "pf" and generates a frequency detecting signal "ve". The multiplier 51 multiplies a frequency detecting signal "ve" by inductance L of the coils 39*b* and 40*b* to calculate impedance (2πfL, "L" denoting inductance and "f" denoting frequency of driving pulse voltages "e1" and "e2") corresponding to one coil and generates an impedance value "vz". The dividers 45A and 46A divide voltage detecting signals "vc" and "vd" from the voltage detecting sections 43 and 44 by the impedance value "vz" and generate current values "ia" and "ib" of the coils 39*b* and 40*b* respectively. The transformer driving circuits 33 and 34 output high-frequency pulses "pc" and "pd" at a level corresponding to primary sides 35*a* and 36*a* of the transformers 35 and 36 based on high-frequency pulses "pe" and "pf" from the voltage controlling oscillator 49. Functions of other components are the same as those shown in FIG. 1. The above voltage detecting sections 43 and 44, dividers 45A and 46A, adder 47, delay circuit 48, voltage controlling oscillator 49, frequency detecting section 50 and multiplier 51 make up a tube current controlling means which is constructed as a one-chip integrated circuit.

In the tube current controlling method employed in the cold cathode tube lighting device, the driving pulse "e1" is supplied to the input terminal of the cold cathode tube 41 through the coil unit 39 and the driving pulse e2 is supplied to the input terminal of the cold cathode tube 42 through the coil unit 40, in which the driving pulses e1 and e2 have phases different from each other and, based on each current flowing through the coils 39*b* and 40*b* in the coil units 39 and 40, a tube current flowing through the cold cathode tube 42 is detected and a frequency of the driving pulses e1 and e2 is controlled so that the tube current becomes a specified current value.

That is, the voltage controlling oscillator 49 oscillates at a specified frequency immediately after when power is turned on and then sends out high-frequency pulses "pe" and "pf" to the transformer driving circuits 33 and 34 respectively. The transformer driving circuit 33 and 34 output high-frequency pulses "pc" and "pd" based on the high-frequency pulses "pe" and "pf". The transformers 35 and 36 are driven in a manner to correspond to frequencies of the high-frequency pulses "pc" and "pd". The frequencies of the high-frequency pulses "pe" and "pf" are detected by the frequency detecting section 50 and a frequency detecting signal "ve" is output to the multiplier 51. In the multiplier 51, the frequency detecting signal "ve" is multiplied by inductance L of the coils 39*b* and 40*b* and impedance (2πfL) corresponding to one coil is calculated and an impedance value "vz" is generated.

The voltage detecting signals "vc" and "vcd" fed from the voltage detecting section 43 and 44 are divided by an impedance value "vz" by the dividers 45A and 46A and current values "ia" and "ib" of the coils 39*b* and 40*b* are obtained. The current value "ia" and the current value "ib" are added by the adder 47 and a tube current "α" of the cold cathode tube 42 is generated. The tube current "α" is sent out, as a tube current "αb", through the delay circuit 48 to the voltage controlling oscillator 49 after a current starts flowing through the cold cathode tubes 41 and 42 in a stable manner. In the voltage controlling oscillator 49, oscillation frequency is set so that the tube current value "αb" becomes a specified current value and high-frequency pulses "pe" and "pf" are output. By repetition of the operations, luminance of the cold cathode tubes 41 and 42 becomes constant.

Third Embodiment

Figure 5:
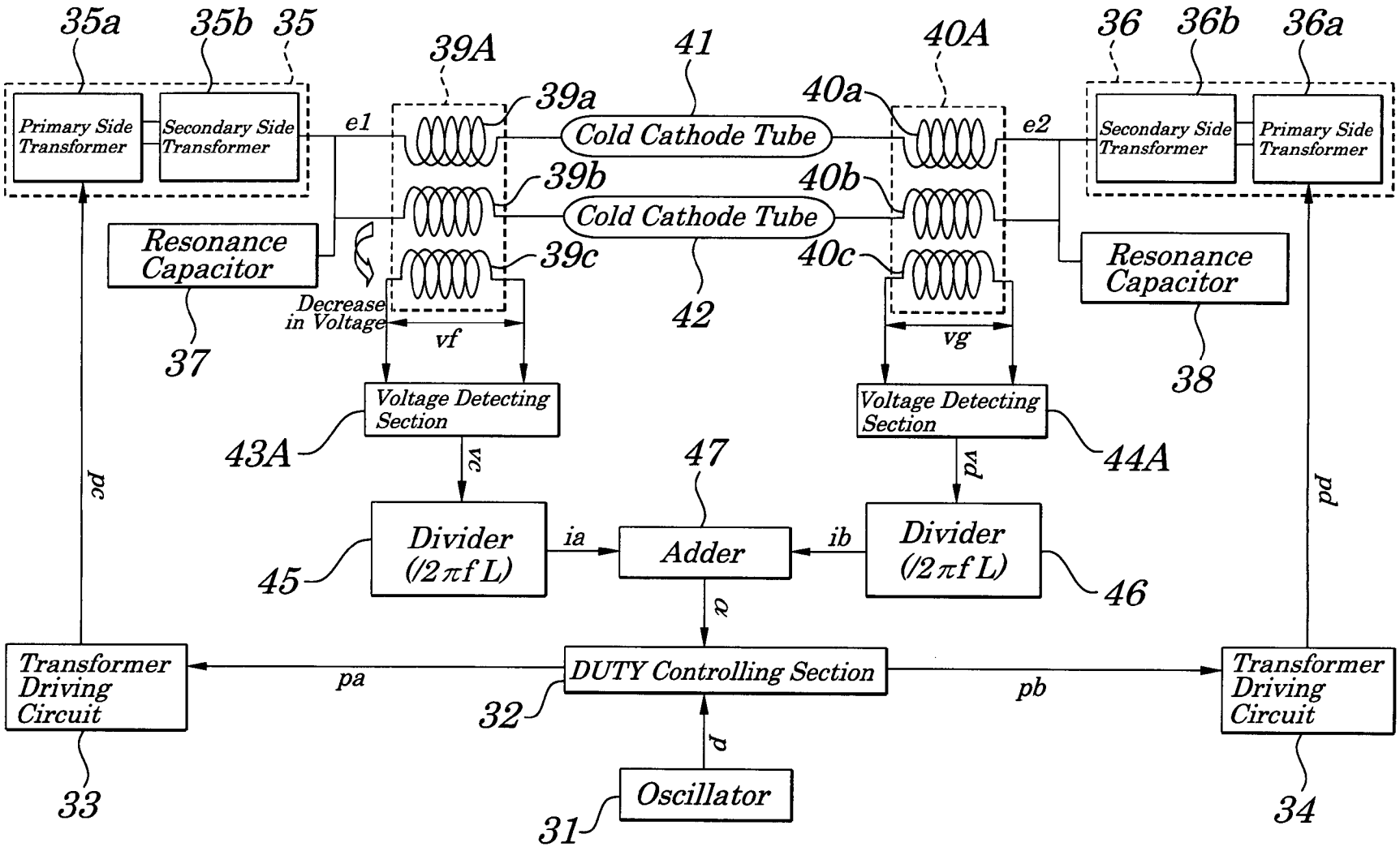
FIG. 5 is a block diagram showing electrical configurations of main components of a cold cathode lighting device according to a third embodiment of the present invention.

FIG. 5 is a block diagram showing electrical configurations of main components of a cold cathode lighting device according to a third embodiment of the present invention. In FIG. 5, same reference numbers are assigned to components having the same functions as those in the first embodiment of FIG. 1. In the cold cathode tube lighting device shown in FIG. 5, instead of the coil units 39 and 40 and the voltage detecting sections 43 and 44, coil units 39A and 40A and voltage detecting sections 43A and 44A, all of which have configurations different from those shown in FIG. 1, are newly provided. In the coil unit 39A, a voltage-reducing coil 39*c* coupled inductively to a coil 39*b* is mounted so as to generate a voltage "vf" being lower than the voltage "va" across the coil 39*b*. In the coil unit 40, a voltage-reducing coil 40*c* also coupled inductively to a coil 40*b* is mounted so as to generate a voltage "vd" being lower than the voltage "vb" across the coil 40*b*.

In this configuration, the voltage-reducing coils 39*c* and 40*c* and the coils 39*b* and 40*b* use the same core commonly. These coil units 39A and 40A make up a tube current detecting circuit in the third embodiment. The voltage detecting section 43A detects the voltage "vf" across the voltage-reducing coil 39*c* to generate a voltage detecting signal "vc" and the voltage detecting section 44A detects the voltage "vg" across the voltage-reducing coil 40*c* to generate a voltage detecting signal "vd". Configurations other than described above are the same as those shown in FIG. 1. The above voltage detecting sections 43A and 44A, dividers 45 and 46, an adder 47, and a DUTY controlling section 32 make up a tube current controlling means in the third embodiment and these components are constructed as a one-chip integrated circuit.

In the tube current controlling method employed in the cold cathode tube lighting device of the third embodiment, the voltages "vf" and "vg" being lower than the voltages "va" and "vb" across the coils 39*b* and 40*b* respectively are generated by the voltage-reducing coils 39*c* and 40*c*. As a result, the cold cathode tube lighting device in the third embodiment has an advantage, in addition to the advantages obtained in the first embodiment, that the voltage detecting sections 43A and 44A are allowed to be constructed by using components with specifications even for low voltages.

Fourth Embodiment

Figure 6:
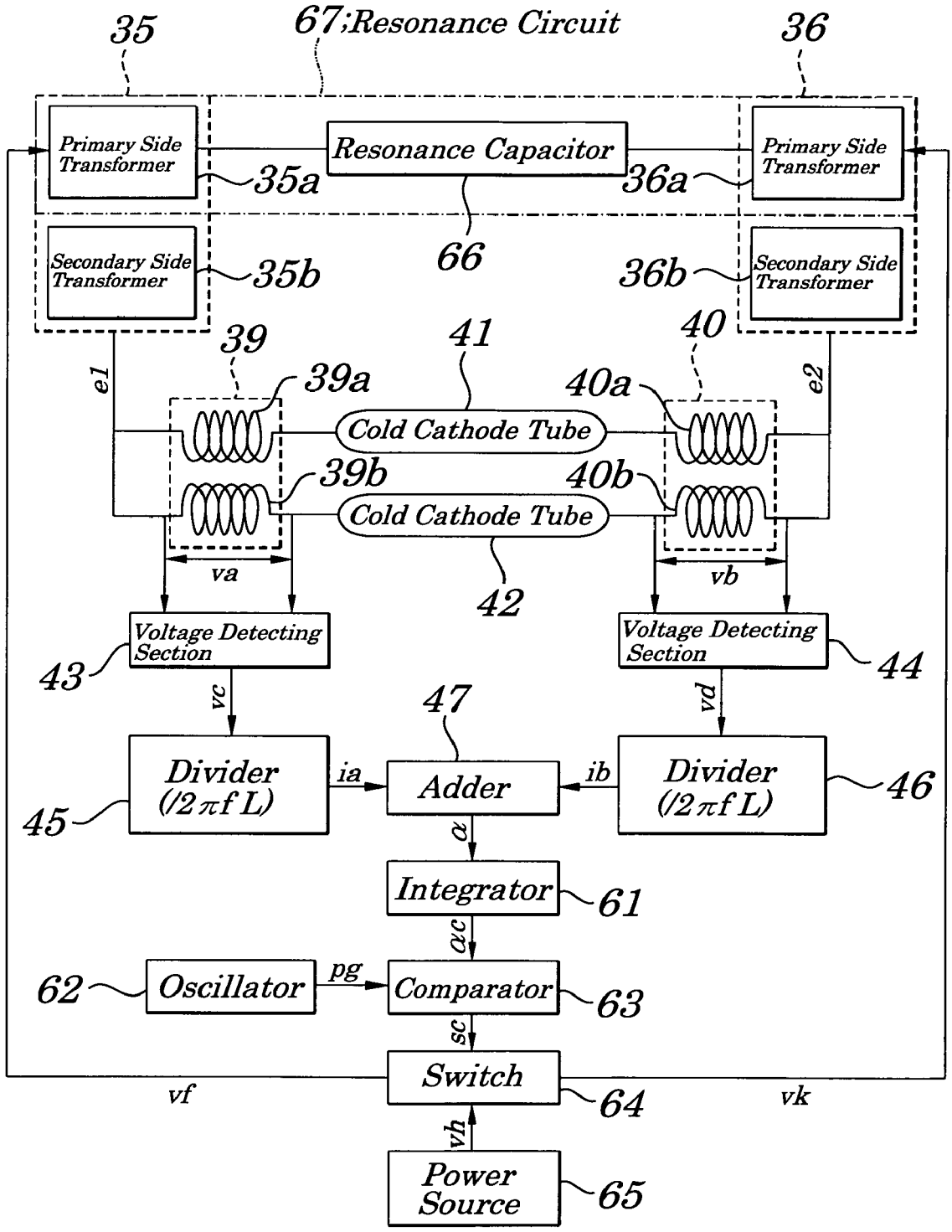
FIG. 6 is a block diagram showing electrical configurations of main components of a cold cathode lighting device according to a fourth embodiment of the present invention.

FIG. 6 is a block diagram showing electrical configurations of main components of a cold cathode lighting device of a fourth embodiment of the present invention. In the cold cathode tube lighting device of the fourth embodiment, as shown in FIG. 6, the oscillator 31, DUTY controlling section 32, transformer driving circuits 33 and 34, resonance capacitors 37 and 38 are excluded and an integrator 61, an oscillator 62, a comparator 63, a switch 64, a power source 65, and a resonance capacitor 66 are newly installed. The resonance capacitor 66 makes up a resonance circuit 67 in combination with conductors on primary sides 35*a* and 36*a* of the transformers 35 and 36, respectively. The resonance capacitor 66 and transformers 35 and 36 make up each of self-exciting inverters. In each of the self-exciting inverters, oscillation is started by the resonance circuit 67 when a source voltage "vh" from the power source 65 is applied through the switch 64 to the primary sides 35*a* and 36*a* of the transformer 35 and 36.

The integrator 61 detects an effective value of a current flowing through a cold cathode tube 42 during a specified unit time by integrating a tube current value "α" fed from the adder 47 and generates a current detecting signal (voltage value) "αc". The oscillator 62 oscillates at a time being sufficiently later than time of oscillation of the resonance circuit 67 and at a frequency causing no flicker in eyes and generates a reference voltage "pg" corresponding to the above frequency by using an F/V (Frequency/Voltage) converter (not shown). The comparator 63 compares the current detecting signal "αc" with a reference voltage "pg" and sends out an ON/OFF controlling signal "sc" to the switch 64 so that the current flowing through the cold cathode tube during the specified unit time becomes a specified current value. The switch 64 allows a power-supply voltage to be applied, as voltages "vj" and "vk", intermittently to primary sides 35*a* and 36*a* of transformers 35 and 36, based on the ON/OFF controlling signal "sc". Voltage detecting sections 43 and 44, dividers 45 and 46, adder 47, the integrator 61, the oscillator 62, the comparator 63, and the switch 64 shown in FIG. 6 make up a tube current controlling means and these components are constructed as a one-chip integrated circuit.

In the tube current controlling method employed in the cold cathode tube lighting device of the fourth embodiment, driving pulses e1 and e2 each having a phase different from each other are applied through coil units 39 and 40 to input terminals on both sides of each of the cold cathode tubes 41 and 42 and a tube current flowing through the cold cathode tube 42 is detected based on each current flowing through coils 39*b* and 40*b* of the coil units 39 and 40, respectively, and a time width during which the driving pulses e1 and e2 are output by each of the above self-exciting inverters is controlled so that the tube current to be detected becomes a specified current value.

That is, the tube current value "α" fed from the adder 47 is integrated by the integrator 61 and, therefore, an effective value of the current flowing through the cold cathode tube 42 during the specified unit time is detected and the current detecting signal "αc" is output from the integrator 61. A comparison between the current detecting signal "αc" and the reference voltage "pg" fed from the oscillator 62 is performed and, therefore, the ON/OFF controlling signal "sc" is output to the switch 64. Based on the ON/OFF controlling signal "sc", the power-supply voltage "vh" fed from the power source 65 is intermittently applied, as supply power "vj" and "vk", through the switch 64 to the primary sides 35*a* and 36*a* and then the cold cathode tubes 41 and 42 are driven by the PWM (Pulse Width Modulation) method so that the tube current "α" becomes a specified current value. This causes the current flowing through the cold cathode tubes 41 and 42 to be kept constant during the specified unit time and luminance of the cold cathode tubes 41 and 42 becomes constant.

Fifth Embodiment

Figure 7:
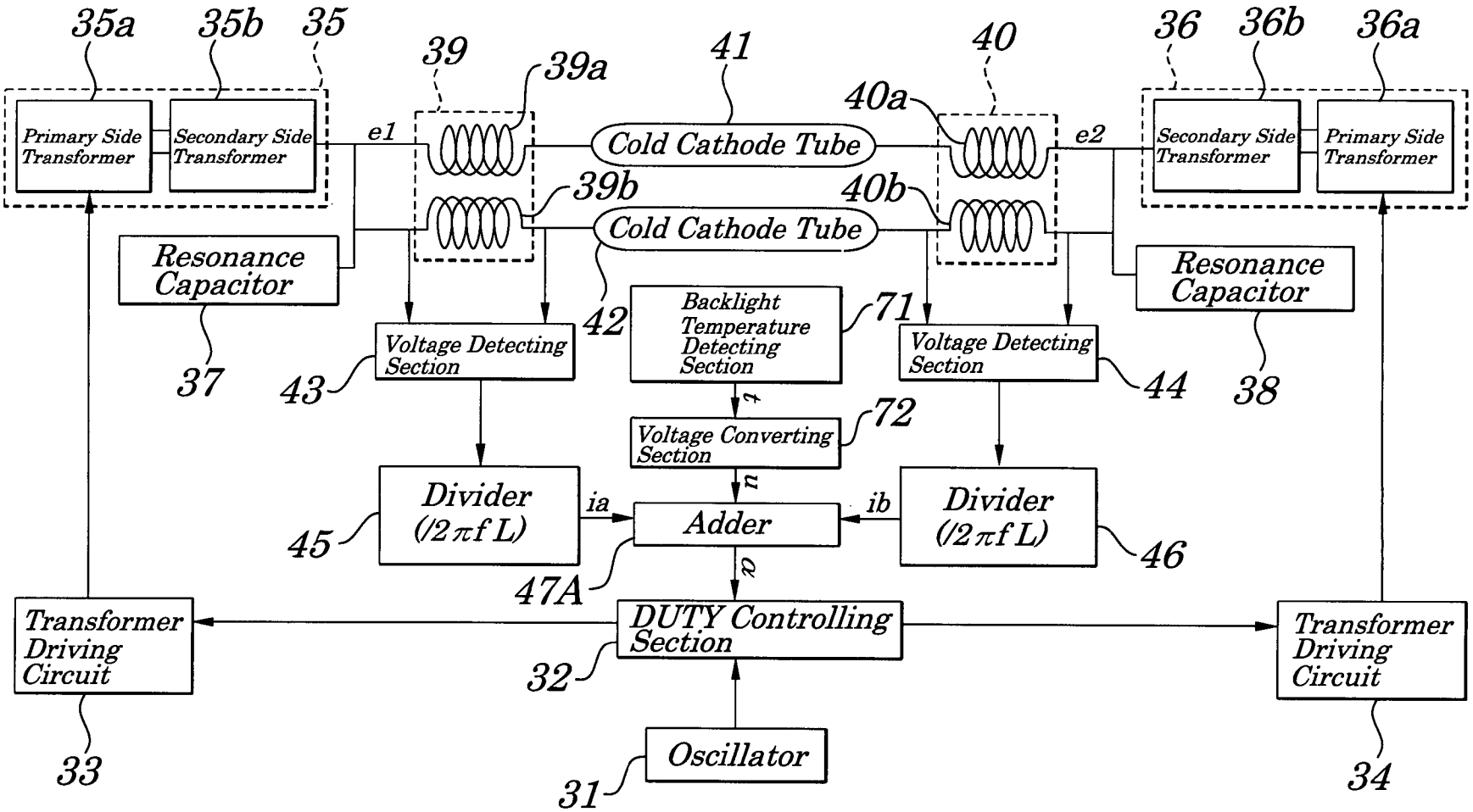
FIG. 7 is a block diagram showing electrical configurations of main components of a cold cathode lighting device according to a fifth embodiment of the present invention.

FIG. 7 is a block diagram showing electrical configurations of main components of a cold cathode lighting device according to the fifth embodiment of the present invention. In the cold cathode lighting device of the fifth embodiment, as shown in FIG. 7, instead of the adder 47 in FIG. 1, an adder 47A having a function different from that of the adder 47, a backlight temperature detecting section 71 and a voltage converting section 72 are provided. The backlight temperature detecting section 71 detects a tube wall temperature "t". The voltage converting section 72 converts the tube wall temperature "t" of the cold cathode tube 42 detected by the backlight temperature detecting section 71 into a voltage value "u". The adder 47A adds the voltage value "u", a current value "ia" fed from a divider 45, and a current value "ib" fed from a divider 46 to output a voltage "α". Configurations other than descried above are the same as those shown in FIG. 1. The voltage detecting sections 43 and 44, dividers 45 and 46, adder 47A, DUTY controlling section 32, backlight temperature detecting section 71, and voltage converting section 72 make up a tube current controlling means in the fifth embodiment and these components are constructed as a one-chip integrated circuit.

In the tube current controlling method employed in the cold cathode tube lighting device, each current flowing through coils 39*b* and 40*b* in coil units 39 and 40 and a tube current flowing through each cold cathode tube is detected based on a temperature of the cold cathode tube 42 detected by the backlight temperature detecting section 71 and a duty ratio of driving pulses e1 and e2 is controlled so that the tube current becomes a specified current value. That is, the tube wall temperature "t" of the cold cathode tube 42 is detected by the backlight temperature detecting section 71. The wall temperature "t" is converted by the voltage converting section 72 into a voltage "u". The voltage value "u", current value "ia" fed from the divider 45, and current "ib" fed from the divider 46 are all added by the adder 47A to output a voltage "α". Thereafter, the same processing performed in the first embodiment is carried out. This enables suppression of a change in currents flowing through the cold cathode tubes 41 and 42 and a change in luminance of the cold cathode tubes 41 and 42 caused by a temperature change, which makes constant the luminance of the cold cathode tubes 41 and 42.

Sixth Embodiment

Figure 8:
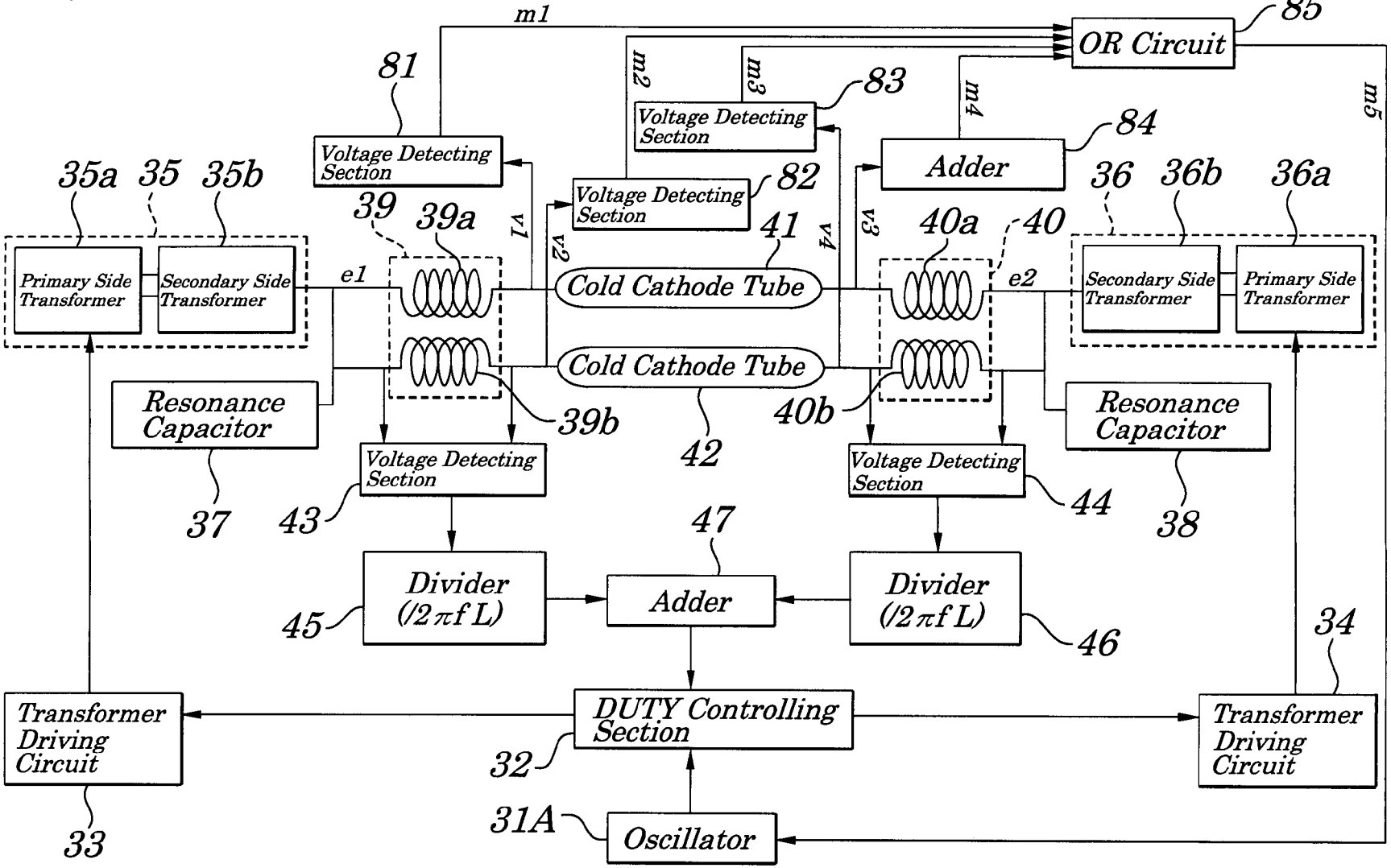
FIG. 8 is a block diagram showing electrical configurations of main components of a cold cathode lighting device according to a sixth embodiment of the present invention.

FIG. 8 is a block diagram showing electrical configurations of main components of a cold cathode lighting device according to the sixth embodiment of the present invention. In the cold cathode tube lighting device of the sixth embodiment, as shown in FIG. 8, instead of the oscillator 31 shown in FIG. 1, an oscillator 31A having a function different form that shown in FIG. 1 is provided. A voltage detecting section 80 is made up of, for example, a comparator and a voltage "v1" of a connecting point between the coil 39*a* and cold cathode tube 41 is compared with a specified reference voltage and outputs, when the voltage "v1" is larger than that of the reference voltage, an abnormal voltage detecting signal "m1" is generated. A voltage detecting section 82 compares a voltage "v2" of a connecting point between the coil 39*b* and cold cathode tube 42 with a reference voltage and outputs, when the voltage "v2" is larger than the reference voltage, an abnormal voltage detecting signal "m2" is generated. A voltage detecting section 83 compares a voltage "v3" of a connecting point between the coil 40*a* and cold cathode tube 41 with a reference voltage and outputs, when the voltage "v3" is larger than the reference voltage, an abnormal voltage detecting signal "m3" is generated. A voltage detecting section 84 compares a voltage "v4" of a connecting point between the coil 40*b* and cold cathode tube 42 with a reference voltage and outputs, when the voltage "v4" is larger than the reference voltage, an abnormal voltage detecting signal "m4" is generated.

An OR circuit 85 generates an abnormal detecting signal "m5" when at least one of the abnormal voltage detecting signals "m1", "m2", "m3", and "m4" occurs. The oscillator 31A stops its operation when the abnormal detecting signal "m5" is generated in the OR circuit 85. The voltage detecting sections 81, 82, 83, and 84 and OR circuit 85 make up a voltage monitoring means. Moreover, the voltage detecting sections 43 and 44, dividers 45 and 46, adder 47, DUTY controlling section 32, voltage detecting sections 81, 82, 83, and 84 and OR circuit 85 are constructed as a one-chip integrated circuit.

In the method of controlling a tube current to be employed in the cold cathode tube lighting device of the sixth embodiment, voltages of the driving pulses e1 and e2 to be applied to input terminals of the cold cathode tubes 41 and 42 are detected by the voltage monitoring means and, if an abnormality occurs in a voltage of at least one of the driving pulses, for example, if voltages e1 and e2 become excessively high due to faulty connection in the cold cathode tubes 41 and 42, the oscillator 31A stops operations and stops operations of each converter. That is, if abnormality in at least one voltage out of voltages "v1", "v2", "v3", and "v4" is detected by the voltage detecting sections 81, 82, 83, and 84, a detecting signal corresponding to at least one of the abnormal voltage detecting signals "m1", "m2", "m3", and "m4" is generated and an abnormality detecting signal "m5" is generated by the OR circuit 85. After that, operations of the oscillator 31A stop. This enables luminance of the cold cathode tubes 41 and 42 to be kept constant and prevents an accident that a voltage of the driving pulses e1 and e2 become excessive.

Figure 9:
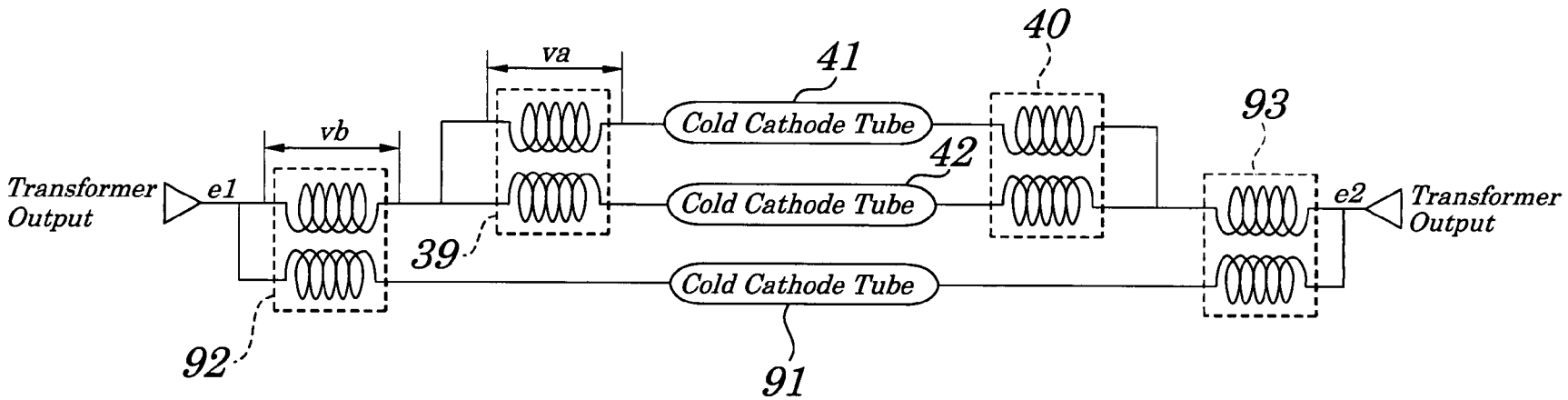
FIG. 9 is a block diagram illustrating a state of connection of coils when three cold cathode tubes are used.
Figure 10:
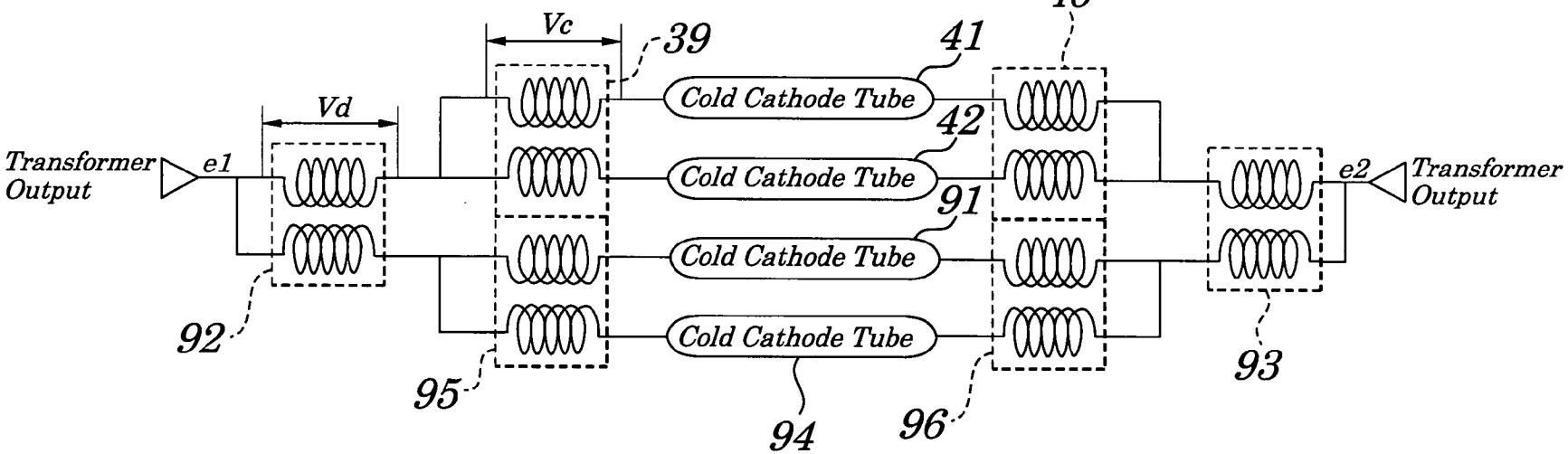
FIG. 10 is a block diagram illustrating a state of connection of coils when four cold cathode tubes are used.

It is apparent that the present invention is not limited to the above embodiments but may be changed and modified without departing from the scope and spirit of the invention. For example, in each of the embodiments, the example is shown in which two cold cathode tubes 41 and 42 are lit by the cold cathode tube lighting device, however, if a larger number of cold cathode tubes is to be lit, by configuring the cold cathode tube lighting device so as to correspond to the number of cold cathode tubes, the cold cathode tube lighting device having almost the same effects and actions as that shown in each of the above embodiments can be achieved. For example, as shown in FIG. 9, when three cold cathode tubes 41, 42, and 91 are to be lit, by additionally connecting coils 92 and 93 and by detecting voltages "va" and "vb" and by exerting control in the same way as in each of the above embodiments, the same effects and actions can be realized. Moreover, as shown in FIG. 10, when four cold cathode tubes 41, 42, 91 and 94 are to be lit, by additionally connecting coils 95 and 96 and by detecting voltages "vc" and "vd" and by exerting control in the same way as in each of the above embodiments, the same effects and actions can be realized.

Figure 11:
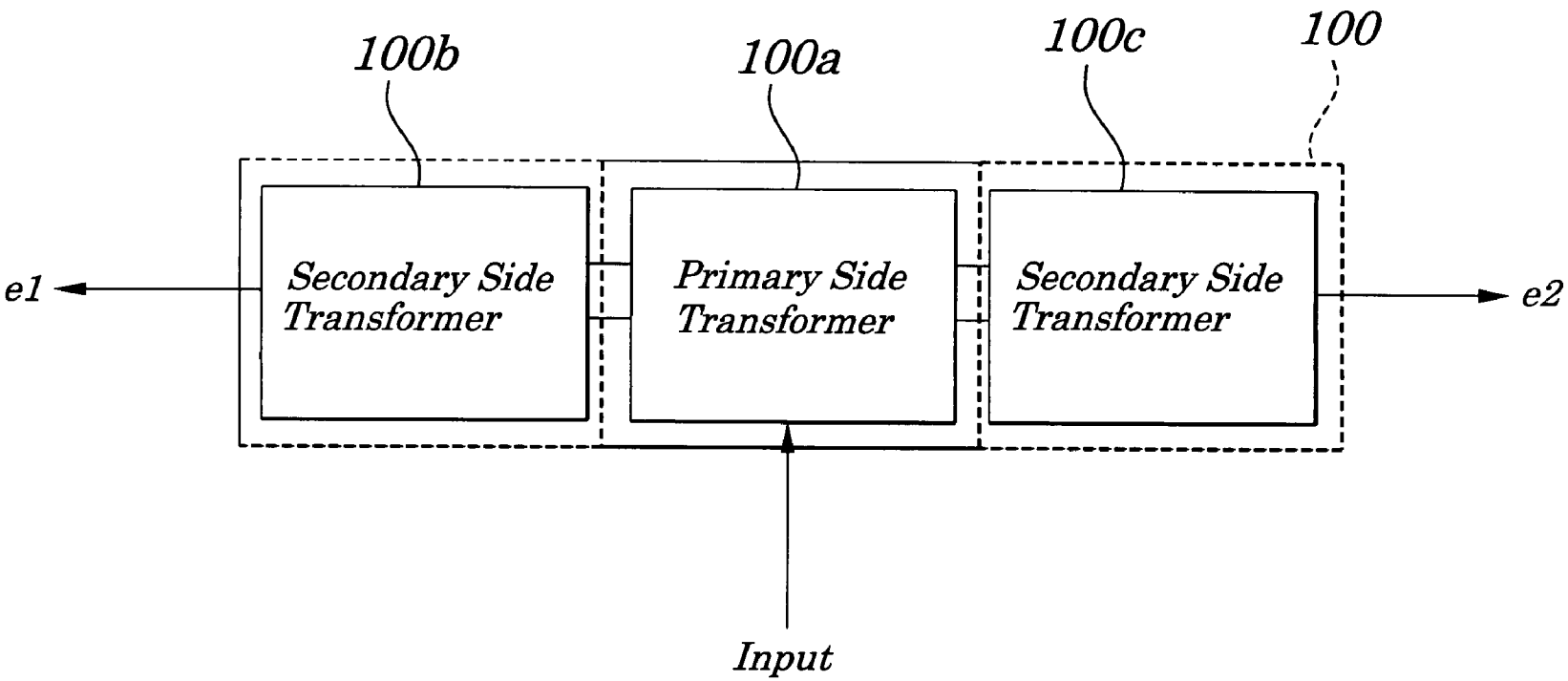
FIG. 11 is a block diagram showing an example of a modified transformer.
Figure 12:
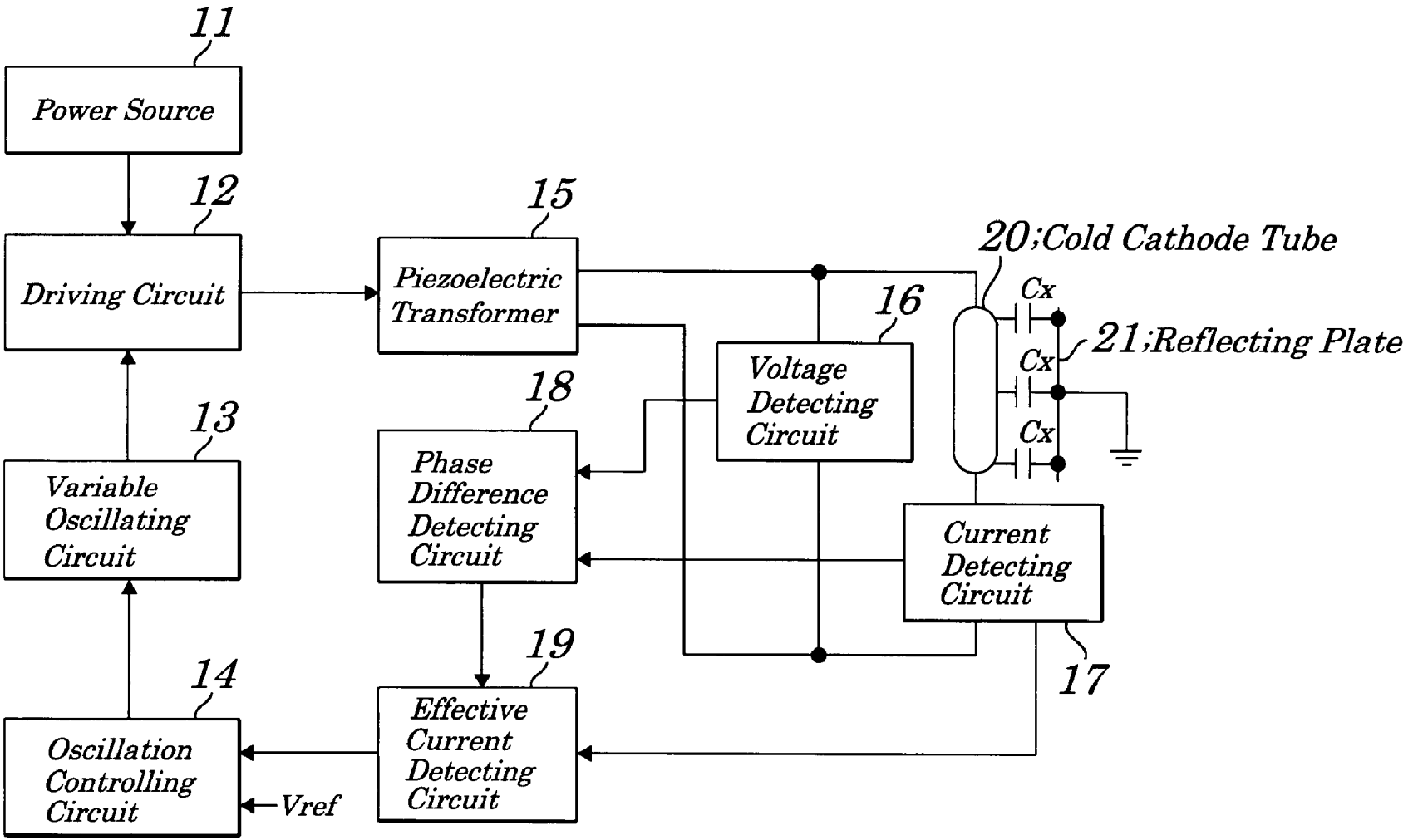
FIG. 12 (RELATED ART)
FIG. 12 is a block diagram showing electrical configurations of a conventional driving device of a piezoelectric transformer stated in Patent Reference 1.

Also, in each of the above embodiments, the transformers 35 and 36 have its primary sides 35*a* and 36*a* and secondary sides 35*b* and 36*b* respectively, however, as shown in FIG. 11, a primary side 100*a* of a transformer 100 that can be used commonly and secondary sides 100*b* and 100*c* coupled inductively may be additionally provided. When the transformer 100 is used, a resonance capacitor 37 and coil unit 39 are connected to the secondary side 100*b* and a resonance capacitor 38 and coil unit 40 are connected to the secondary side 100*c*. To the primary side 100*a* is connected a transformer driving circuit. In this case, one transformer driving circuit is enough and, therefore, component counts can be decreased when compared with the case of each of the above embodiments where two transformer driving circuits 33 and 34 are used.

The cold cathode tube lighting device of the present invention may be also configured so that coil units 39A and 40A and voltage detecting sections 43A and 44A employed in the third embodiment shown in FIG. 5 are used instead of the coil units 39 and 40 and voltage detecting sections 43 and 44 employed in the second embodiment shown in FIG. 4. Similarly, the cold cathode tube lighting device of the present invention may be also configured so that coil units 39 and 40 and voltage detecting sections 43 and 44 employed in the fourth embodiment shown in FIG. 6 are used instead of the coil units 39A and 40A and voltage detecting sections 43A and 44A employed in the third embodiment shown in FIG. 5. Also, the cold cathode tube lighting device of the present invention may be configured so that the adder 47A, backlight temperature detecting section 71 and voltage converting section 72 employed in the fifth embodiment shown in FIG. 7 are used instead of the adder 47 in FIGS. 4, 5, and 6.

Also, the cold cathode tube lighting device of the present invention may be configured so that the oscillator 31A, voltage detecting sections 81, 82, 83, and 84 and the OR circuit 85 employed in the sixth embodiment in FIG. 8 are used instead of the oscillator 31 shown in FIG. 1, 5, or 7. In this case, the voltage detecting sections 81, 82, 83, and 84 and OR circuit 85 shown in FIG. 8 and the voltage detecting sections 43 an 44, dividers 45 and 46, adders 47, and DUTY controlling section 32 shown in FIG. 1 may be constructed as a one-chip integrated circuit. The voltage detecting sections 81, 82, 83, and 84 and OR circuit 85 shown in FIG. 8 and the voltage detecting sections 43A and 44A, dividers 45 and 46, adder 47, and DUTY controlling section 32 shown in FIG. 5 may be constructed as a one-chip integrated circuit. Furthermore, the voltage detecting sections 81, 82, 83, and 84 and OR circuit 85 shown in FIG. 8 and the voltage detecting sections 43 and 44, dividers 45 and 46, adder 47A, DUTY controlling section 32, backlight temperature detecting sections 71, and voltage converting section 72 shown in FIG. 7 may be constructed as a one-chip integrated circuit.

Moreover, the cold cathode tube lighting device in FIG. 4 may be constructed so that the voltage detecting sections 81, 82, 83, and 84 and the OR circuit 85 shown in FIG. 8 are provided and so that operations of the voltage controlling oscillator 49 shown in FIG. 4 are stopped by an abnormal detecting signal "m5" fed from the OR circuit 85 shown in FIG. 8. In this case, the voltage detecting sections 81, 82, 83, and 84 and OR circuit 85 shown in FIG. 8 and the voltage detecting sections 43 and 44, divider 45A and 46A, adder 47, delay circuit 48, voltage controlling oscillator 49, frequency detecting section 50, and multiplier 51 may be constructed as a one-chip integrated circuit.

The cold cathode tube lighting device in FIG. 6 may be constructed so that the voltage detecting sections 81, 82, 83, and 84 and the OR circuit 85 shown in FIG. 8 are provided and so that operations of the oscillator 62 shown in FIG. 6 are stopped by an abnormal detecting signal "m5" fed from the OR circuit 85 shown in FIG. 8. In this case, the voltage detecting sections 81, 82, 83, and 84 and OR circuit 85 shown in FIG. 8, and the voltage detecting sections 43 and 44, dividers 45 and 46, adder 47, integrator 61, oscillator 62, comparator 63, and switch 64 may be constructed as a one-chip integrated circuit.

Furthermore, in each of the above embodiments, the coils are used as a ballast element, however, except the case of the third embodiment, by using a capacitor as the ballast element, the same actions and effects as those obtained by the embodiment can be achieved. In this case, however, driving pulses e1 and e2 having a high voltage are required.

The present invention can be used entirely in a cold cathode tube lighting device to be driven by pulses which are output from inverters and are supplied to input terminals on both sides of each of two or more cold cathode tubes to be used as a backlight for a liquid crystal display device.

What is claimed is:

1. A cold cathode tube lighting device for lighting two or more cold cathode tubes by applying driving pulses with different phases to be output from each of inverters through each of ballast elements used to make uniform a tube current of each of said cold cathode tubes to input terminals on both sides of each of two or more cold cathode tubes comprising:

a tube current controlling unit to detect each current flowing through each of ballast elements based on a voltage detected by a voltage detecting section and to detect a tube current flowing through each of said cold cathode tubes based on the detected each current flowing through each of ballast elements and to control so that said tube current becomes a specified current value, wherein each ballast element is a coil unit, and each coil unit is bridged by a voltage detecting section.

2. The cold cathode tube lighting device according to claim 1, wherein each of said ballast elements comprises a coil and wherein first and second voltage-reducing coils are provided which generate a voltage being lower than a voltage across each of coils each being coupled inductively to each of the coils connected to each of input terminals on both sides of one of said two or more cold cathode tubes and wherein said tube current controlling unit detects a current flowing through each of said coils based on a voltage to be generated in each of said voltage-reducing coils.

3. The cold cathode tube lighting device according to claim 1, wherein each voltage detecting section is connected to a divider, output from the dividers is input to an adder, a tube current value $\alpha$ from the adder is input to a duty controlling section driven by an oscillator, and high frequency pulses pa and pb from the duty controlling section are sent to the ballast elements via at least one transformer.

4. The cold cathode tube lighting device according to claim 1, wherein the inverter comprises first and second separately-excited inverters and wherein said tube current controlling unit detects each current flowing through each of said ballast elements on both sides of each of said two or more cold cathode tubes and calculates said tube current based on a value obtained by adding said each current and sets a duty ratio of each of said driving pulses on each of said separately-excited inverters so that said tube current becomes said specified current value.

5. The cold cathode tube lighting device according to claim 4, wherein each of said ballast elements comprises a coil and wherein first and second voltage-reducing coils are provided which generate a voltage being lower than a voltage across each of coils each being coupled inductively to each of the coils connected to each of input terminals on both sides of one of said two or more cold cathode tubes and wherein said tube current controlling unit detects a current flowing through each of said coils based on a voltage to be generated in each of said voltage-reducing coils.

6. The cold cathode tube lighting device according to claim 1, wherein said inverter comprises first and second separately-excited inverters and wherein said tube current controlling unit detects each current flowing through each of said ballast elements on both sides of each of said two or more cold cathode tubes and calculates said tube current based on a value obtained by adding each current and sets a frequency of each of said driving pulses on each of said separately-excited inverters so that said tube current becomes said specified current value.

7. The cold cathode tube lighting device according to claim 6, wherein each of said ballast elements comprises a coil and wherein first and second voltage-reducing coils are provided which generate a voltage being lower than a voltage across each of coils each being coupled inductively to each of the coils connected to each of input terminals on both sides of one of said two or more cold cathode tubes and wherein said tube current controlling unit detects a current flowing through each of said coils based on a voltage to be generated in each of said voltage-reducing coils.

8. The cold cathode tube lighting device according to claim 1, wherein said inverter comprises first and second self-excited inverters and wherein said tube current controlling unit detects each current flowing through each of said ballast elements on both sides of each of said two or more cold cathode tubes and calculates said tube current based on a value obtained by adding each current and controls a time width during which each of said driving pulses is output by each of said self-exiting inverters so that said tube current becomes said specified current value.

9. The cold cathode tube lighting device according to claim 8, wherein each of said ballast elements comprises a coil and wherein first and second voltage-reducing coils are provided which generate a voltage being lower than a voltage across each of coils each being coupled inductively to each of the coils connected to each of input terminals on both sides of one of said two or more cold cathode tubes and wherein said tube current controlling unit detects a current flowing through each of said coils based on a voltage to be generated in each of said voltage-reducing coils.

10. The cold cathode tube lighting device according to claim 1, wherein said tube current controlling unit is configured as one chip of an integrated circuit.

11. An integrated circuit as set forth in claim 10.

12. The cold cathode tube lighting device according to claim 1, wherein a voltage monitoring unit is provided which detects a voltage of each of said driving pulses to be applied to each of input terminals of each of said cold cathode tubes and stops operations of each of said inverters when abnormality occurs in at least one driving pulse.

13. The cold cathode tube lighting device according to claim 12, wherein said tube current controlling unit and said voltage monitoring unit are together configured as one chip of an integrated circuit.

14. An integrated circuit as set forth in claim 13.

15. The cold cathode tube lighting device according to claim 1, wherein a temperature detecting unit is provided which detects a temperature of each of said cold cathode tubes and wherein said tube current controlling unit detects a tube current flowing through each of said cold cathode tubes based on each current flowing through each of said ballast elements and on a temperature of each of said cold cathode tubes detected by said temperature detecting unit and exercises control so that said tube current becomes a specified current value.

16. The cold cathode tube lighting device according to claim 15, wherein a voltage monitoring unit is provided which detects a voltage of each of said driving pulses to be applied to each of input terminals of each of said cold cathode tubes and stops operations of each of said inverters when abnormality occurs in at least one driving pulse.

17. The cold cathode tube lighting device according to claim 16, wherein said temperature detecting unit, said tube current controlling unit and said voltage monitoring unit are together configured as one chip of an integrated circuit.

18. The cold cathode tube lighting device according to claim 15, wherein said temperature detecting unit and said tube current controlling unit are together configured as one chip of an integrated circuit.

19. An integrated circuit as set forth in claim 18.

20. A tube current controlling method to be used in a cold cathode tube lighting device which applies driving pulses with different phases to be output from each of inverters through each of ballast elements used to make uniform a tube current of each of said cold cathode tubes to input terminals on both sides of each of two or more cold cathode tubes, wherein each ballast element is a coil unit, and each coil unit is bridged by a voltage detecting section, said tube current controlling method comprising:

detecting each current flowing through each of ballast elements based on a voltage detected by said voltage detecting section, and detecting a tube current flowing through each of said cold cathode tubes based on the detected each current flowing through each of said ballast elements and exerting control so that said tube current becomes a specified value.

* * * * *